US005983461A

United States Patent [19]

Chen

[11] Patent Number: 5,983,461

[45] Date of Patent: Nov. 16, 1999

[54] STRUCTURE OF SUPPORTER FOR TIE KNOT OF KNOTTING-FREE NECKTIE

[76] Inventor: Jiann-Jong Chen, No.23, Alley 21, Lane 244, Sec.5, Yen-Pin North Road, Taipei, Taiwan

[21] Appl. No.: 09/167,720

[22] Filed: Oct. 7, 1998

[51] Int. Cl.[6] ..... A41D 25/00

[52] U.S. Cl. ..... 24/66.9; 24/115 H; 24/65

[58] Field of Search ..... 24/49.1, 65, 66.9, 24/136 R, 129 R, 115 H, 18; 2/144, 145, 148, 149, 150, 151

[56] References Cited

U.S. PATENT DOCUMENTS

| | | | |
|---|---|---|---|
| 2,972,750 | 2/1961 | Kanter | 24/65 X |
| 3,222,684 | 12/1965 | Kanter et al. | 24/65 X |
| 3,453,698 | 7/1969 | Mosby | 24/66.9 |
| 4,035,873 | 7/1977 | Epperson | 24/66.9 |
| 4,912,814 | 4/1990 | McKenzie | 24/66.9 X |

FOREIGN PATENT DOCUMENTS

| | | | |
|---|---|---|---|
| 679675 | 12/1964 | Italy | 24/65 |

*Primary Examiner*—James R. Brittain
*Assistant Examiner*—Robert J. Sandy
*Attorney, Agent, or Firm*—Harold L. Novick; Nath & Associates

[57] ABSTRACT

A structure of supporter for a tie knot of a knotting-free necktie comprises an outer shell and a back wing connected to the outer shell. The outer shell, as seen from its front view, being of a reverse triangular shape having two waist portions concave inward of the outer shell, and as seen from its top view, being of a bow shape. A protective beam, resistant shoulders and protective tabs are provided at the rear side of the outer shell. A back wing is fitted onto the rear side of the outer shell, and two side wing portions being somewhat resilient are lightly pressed against the two resistant shoulders. When mounting a loop cord, two ends of the loop cord are first threaded in the supporter from the bottom of the protective tab, passing through the resistant shoulders, and threaded out of the supporter from the bottom of the protective beams, and then a fabric strip, which is a half of a conventional necktie, is wound around the supporter and knotted in order to form a tie knot whereby a knotting-free necktie is obtained.

1 Claim, 5 Drawing Sheets

STRUCTURE OF SUPPORTER FOR TIE KNOT OF KNOTTING-FREE NECKTIE

FIELD OF THE INVENTION

The present invention relates to a knotting-free necktie, and more particularly, to a structure of a supporter for the tie knot of a knotting-free necktie.

DESCRIPTION OF THE PRIOR ART

Up to now, business suit has become a common dress in the world. However, it is unknown who designs the business suit. Since the collar of the shirt is open, the original business suits are most likely to be worn in a tropical area rather than a frigid zone, and thus when people living in the frigid zone wear the business suit, they will use a scarf around the neck and knot the scarf for protecting them from cold. At first, the purpose of the scarf is to protect people from cold, but later the scarf is found to be ornamental and a necktie is gradually developed. This maybe can explain how the necktie is developed, but the real reason is unknown. Today, the necktie has totally become a part, even a main part of the business suit. If a man wears a business suit without a necktie, he can not be accepted in a formal occasion and will be deemed to be impolite or not be dressed neatly.

An ordinary necktie is generally made by sewing a fabric into an elongate strip having a wider head portion and a narrower tail portion. When in use, the waist portion of the strip is wound under the collar of the shirt and is formed into a tie knot, and then the head portion of the strip will suspended from the collar, in front of the user's chest. When people want to knot such a necktie, it is difficult to determine the optimum position of the knotting, and thus it is not efficient. Hence, people have proposed knotting-free neckties to solve this problem.

Some knotting-free neckties are hung on the collar by means of a hook, and some improved knotting-free neckties utilizes zippers to control the upward-and-downward movement of the tie knot. However, the zipper has a tooth portion, which will make people feel uncomfortable when touching them. It is also necessary to use locking means to prevent the zipper from sliding after being pulled; however, it is not appropriate to mount a tab or a slide on the necktie or controlling and locking the zipper, and thus the zipper can not be locked and is liable to slide such that the tie knot cannot be stable and held at the collar and will gradually slide downward.

For solving this problem, the best way is to study the supporter for the necktie, and the purpose of the present application is to provide a supporter for the necktie.

SUMMARY OF THE INVENTION

To form a tie knot by winding a fabric strip (i.e., a necktie) around the supporter according to the present application, an outer shell of the supporter is formed into a reverse triangular shape and has two waist portions concave inward of the outer shell, as seen from its front view. The outer shell is of a bow shape if seen from its top view. The rear side of the outer shell is provided with a protective beam, resistant shoulders and protective tabs in order to guide the sliding of a loop cord. A back wing is fitted onto the rear side of the outer shell, and has two side wing portions, which are somewhat resilient and are lightly pressed against the resistant shoulders such that the loop cord passing over the resistant shoulders can move smoothly but not slidably and make the tie knot, which can be moved upward-and-downward by means of the movement of the loop cord, produce an appropriate resistant force against sliding.

BRIEF DESCRIPTION OF THE DRAWINGS

These and other attributes of the present invention will become more clear upon a thorough study of the following description of the preferred embodiment for carrying out the invention, particularly when reviewed in conjunction with the drawings, wherein.

DETAILED DESCRIPTION OF THE INVENTION

Figure 1A:
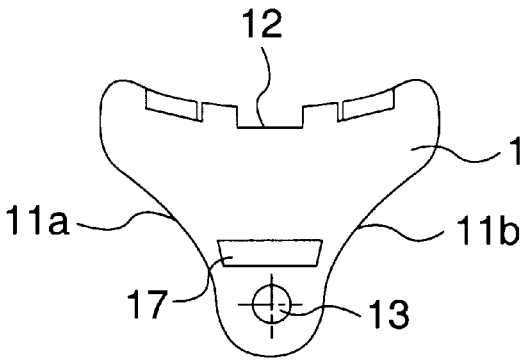
FIG. 1A is a front view of an outer shell of th- supporter in accordance with the present invention.
Figure 1B:
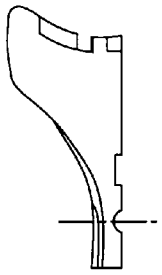
FIG. 1B is a side view of the outer shell of the supporter in accordance with the present invention.
Figure 1C:
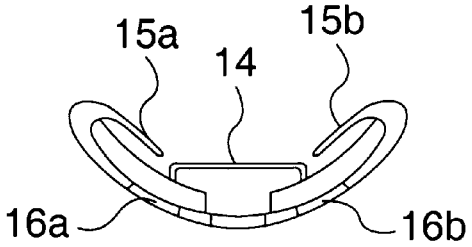
FIG. 1C is a top view of the outer shell of the supporter in accordance with the present invention.
Figure 2A:
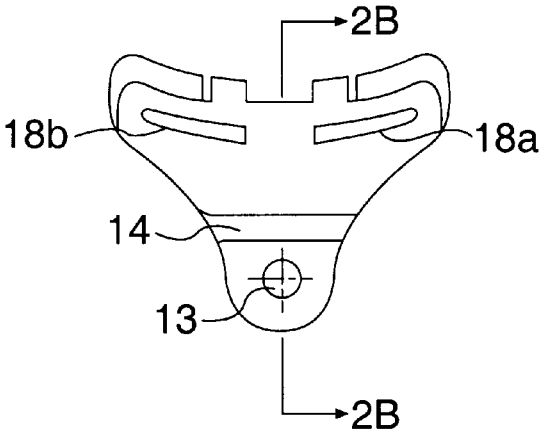
FIG. 2A is a rear view of the outer shell of the supporter in accordance with the present invention.
Figure 2B:
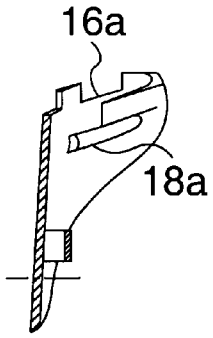
FIG. 2B is a sectional view of the outer shell of the supporter of FIG. 2A along a line A—A.

FIGS. 1A, 1B and 1C show a front view, a side view and a top view of the outer shell of the supporter according to the present invention, respectively. FIGS. 2A is a rear view of the outer shell and FIG. 2B is a sectional view of the outer shell of FIG. 2A along a line A—A.

As seen from these figures, the outer shell (1) of the supporter according to the present invention is substantially in a shape of reverse triangle, and two waist portions (11a, 11b) of the outer shell (1) are concave inward of the outer shell (1). As seen from the top view of the outer shell (1), it is in a shape of bow. The outer shell (1) according to the present invention is so designed that an ornamental tie knot can be formed by merely winding a fabric strip onto the outer shell (1) and knotting the fabric strip, while a conventional necktie has to be wound several times in order to form a multi-layer tie knot for matching the collar.

To support an ornamental appearance of the tie knot is merely one of the functions of the supporter. The main function of the supporter is to control the upward-and-downward movement of the tie knot and holding the tie knot in an appropriate position. The following description will explain how to achieve this object.

As seen from FIG. 1A, a rectangular window (17) formed above a fixing hole (13) and two slots (16*a*, 16*b*) formed respectively at two sides of the upper edge of the outer shell (1) have no special functional effect but are merely made from a mold, and thus will not be described in detail here. A protective beam (14), protruding resistant shoulders (18*a*, 18*b*) and protection tabs (15*a*, 15*b*) are provided at the rear side of the outer shell (1).

Figure 3A:
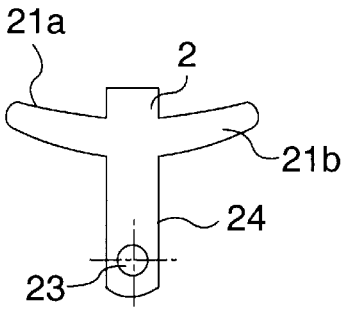
FIG. 3A is a front view of a back wing of the supporter in accordance with the present invention.
Figure 3B:
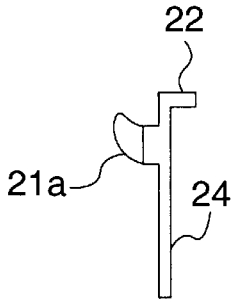
FIG. 3B is a side view of the back wing of the supporter in accordance with the present invention.
Figure 3C:
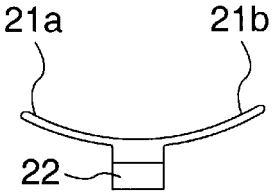
FIG. 3C is a top view of the back wing of the supporter in accordance with the present invention.

FIG. 3A is a front view of a back wing (2) of the supporter according to the present invention; FIG. 3B is a side view of the back wing (2); and FIG. 3C is a top view of the back wing (3).

Figure 5A:
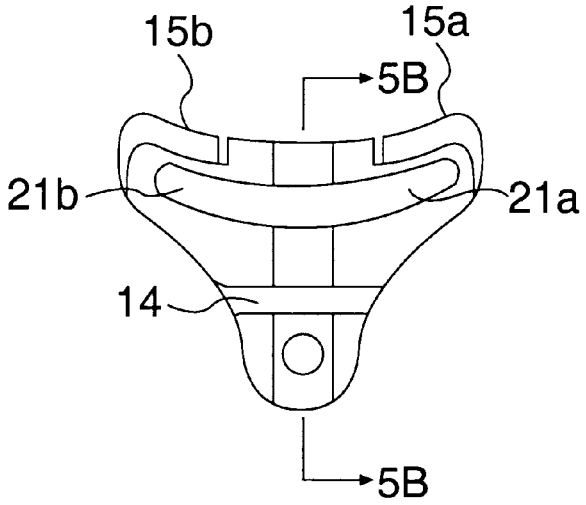
FIG. 5A is a rear view of the supporter of FIG. 4A.

The back wing (2) can be fitted onto the outer shell (1), as shown in FIG. 5A, and a fixing hole (23) of the back wing (2) aligns with the fixing hole (13) of the outer shell (1). By threading a rivet into the fixing hole (13, 23), the back wing (2) can be fixed onto the outer shell (1). A hanging portion (22) is adapted to be hung on a small groove (12) provided in the middle of the upper edge of the outer shell (1) in order to prevent the biasing of the back wing (2). Two side wing portions (21*a*, 21*b*) directly press against the resistant shoulders (18*a*, 18*b*), respectively. Because the back wing (2) is made of a resilient plastic material and its wing trunk (24) and the two side wing portions (21*a*, 21*b*) are all flat, when the fixing hole (23) of the back wing (2) is fixed onto the outer shell (1), the pressure applied by the two side wing portions (21*a*, 21*b*) on the resistant shoulders (18*a*, 18*b*) is a resilient action, and when forming a tie knot, a fabric strip (4) will be wound around and be pressed against the outer ends of the two side wing portions (21*a*, 21*b*) and thus produce a resilient pressure onto the two side wing portions. Such pressure can produce an appropriate resistance on a moving loop cord (3), which is between the resistant shoulders (18*a*, 18*b*) and the two side wing portions (21*a*, 21*b*) (see FIG. 6), such that the loop (cord (3) can be pulled smoothly but not slidably, and if no foreign force is applied to the loop cord (3), the loop cord (3) will be held in a position and will not move. Because the tie knot is formed by winding the fabric strip around the supporter, the smooth and stable movement of the supporter when being pulled results in the smooth and stable upward-and- downward movement of the tie knot. Although the resistance can firmly hold the tie knot on the collar, it will not produce pressure on the throat of the user. The natural tension of the neck muscle can automatically adjust the tightness of the loop cord.

Figure 4A:
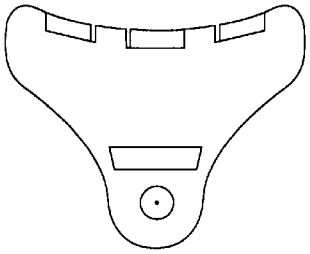
FIG. 4A is a front view of an assembled supporter of the present invention, in which the back wing is connected with the outer shell.
Figure 4B:
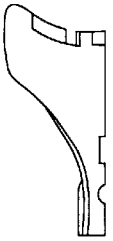
FIG. 4B is a side view of the assembled supporter of the present invention, in which the back wing is connected with the outer shell.
Figure 4C:
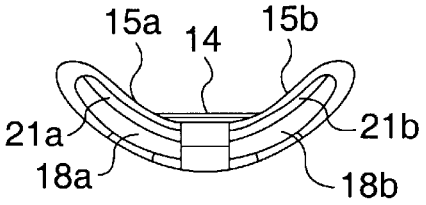
FIG. 4C is a top view of the assembled supporter of the present invention, in which the back wing is connected with the outer shell.

FIG. 4A is a front view of an assembled supporter according to the present invention, in which the back wing is connected with the outer shell; FIG. 4B is a side view of the assembled supporter of FIG. 4A; and FIG. 4C is a top view of the assembled supporter of FIG. 4A.

Figure 5B:
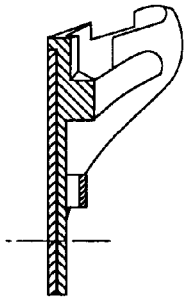
FIG. 5B is a sectional view of the supporter of Fir. 5A along a line B—B.

FIG. 5A is a rear view of the supporter of FIG. 4A showing the back wing (2) of FIG. 3A fitted onto the back of the outer shell (1) of FIG. 2A; and FIG. 5B is a sectional view of the supporter of FIG. 5A along a line B—B.

As seen from these figures, the resistant shoulders (18*a*, 18*b*) shown in FIG. 2A is covered by the two side wing portions (21*a*, 21*b*) of the back wing (2).

Figure 6:
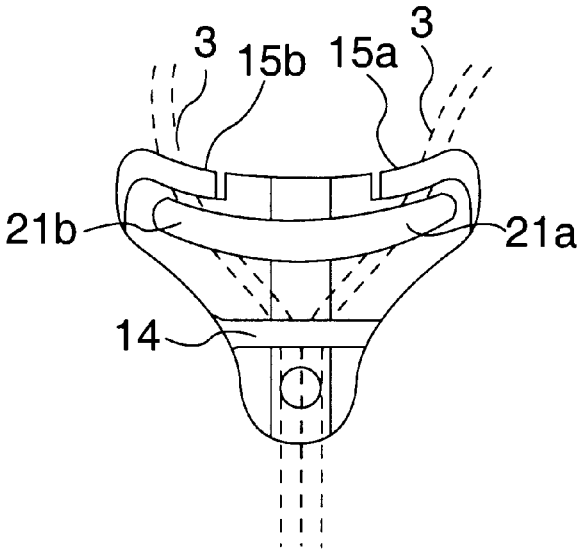
FIG. 6 is a schematic view showing a loop cord passing through the rear side of the supporter of the present invention.

In FIG. 6, the loop cord (3), which is formed into two strands, is threaded in the supporter from the bottom of the protective beam (14), and then passes under the two side wing portions (21*a*, 21*b*) of the back wing (2) and is threaded out of the supporter from the bottom of the protective tabs (15*a*, 15*b*).

Figure 7:
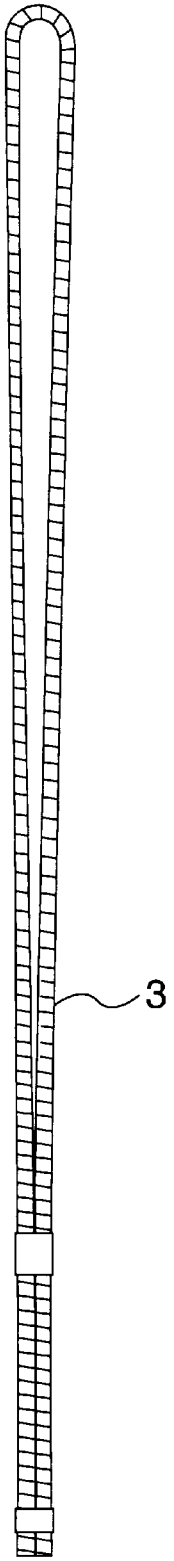
FIG. 7 shows the appearance of the loop cord of FIG. 6.

FIG. 7 shows a loop cord (3), which is a part of the necktie and can be fitted around the collar. The loop cord is made of a fabric having appropriate softness, and it can be a loop cord having a round section, or be a flat loop cord, but the former is preferable.

Figure 8:
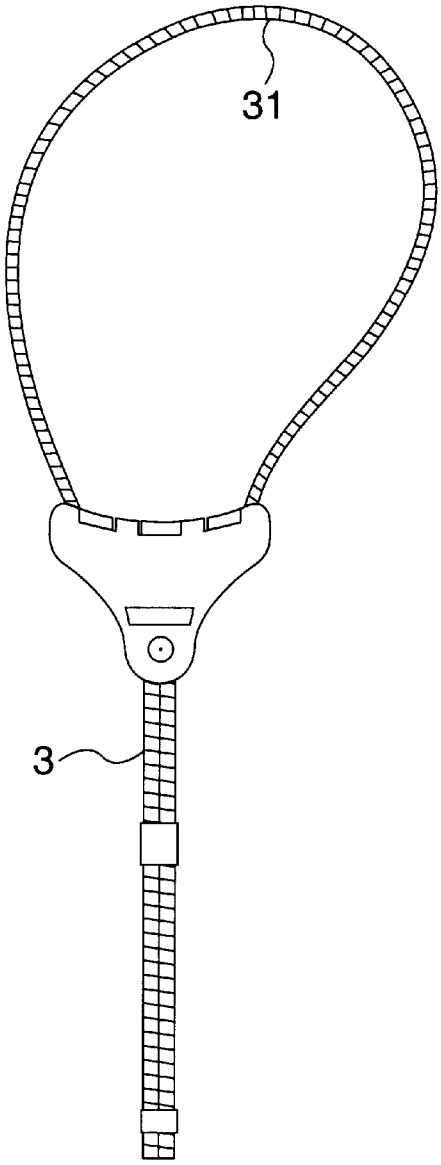
FIG. 8 shows the appearance of the loop cord which has been threaded through the supporter.

FIG. 8 shows the appearance of the loop cord (3) of FIG. 7 that passes through the supporter in a manner shown in FIG. 6, and the portion of the loop cord (3) above the supporter forms an adjustable collar ring (31).

Figure 9:
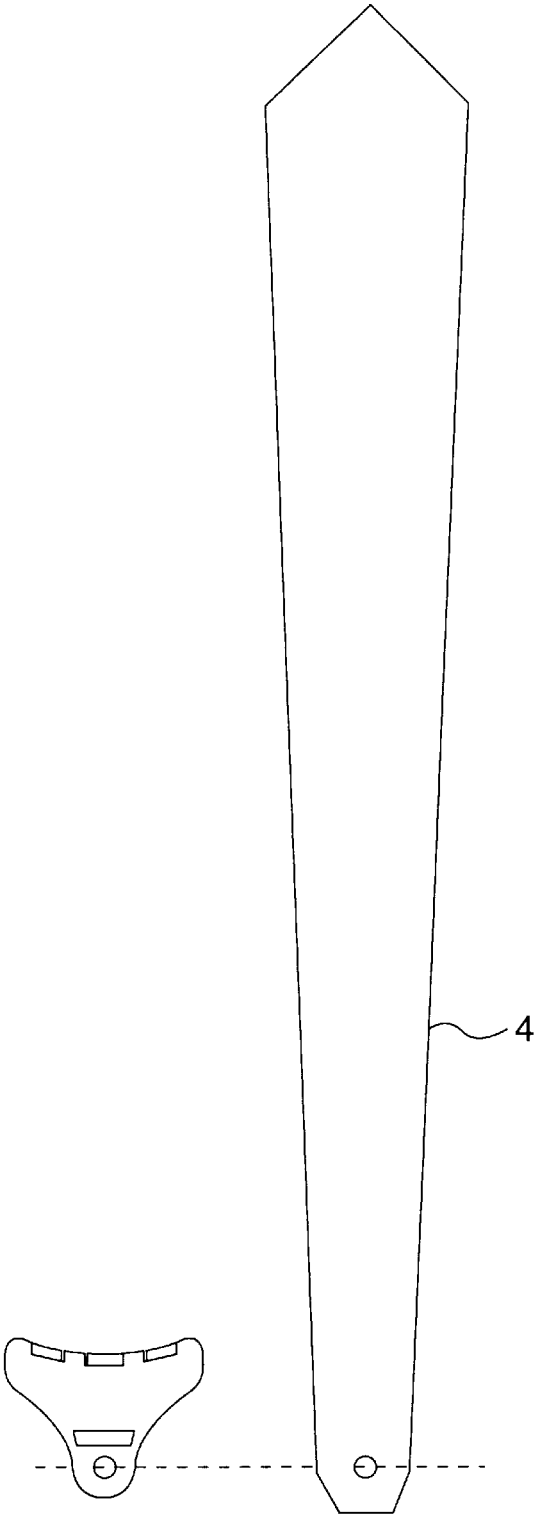
FIG. 9 shows a fabric strip.

FIG. 9 shows a fabric strip (4). As seen from th(e figure, the fabric strip (4) has a fixing hole (41) at its bottom end. When mounting the fabric strip (4), the user can use a rivet passing through the fixing hole (41) of the fabric strip (4), the fixing hole (13) of the outer shell (1) and the fixing hole (23) of the back wing (2) in order to connect the fabric strip (4), the outer shell (1) and the back wing (2) together, and then wind the fabric strip (4) around the supporter in order to form a tie knot (42) and fix the same whereby a knotting-free necktie is obtained.

Figure 10:
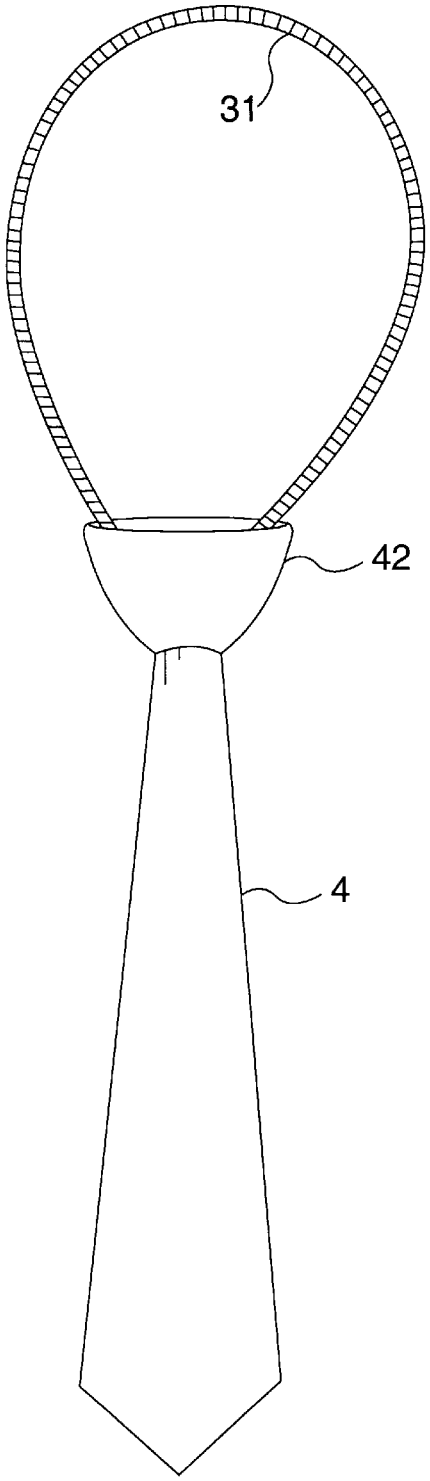
FIG. 10 shows a whole knotting-free necktie.

FIG. 10 is an appearance of the whole knotting-free necktie. When in use, the user first puts the collar ring (31) under the (collar of the shirt and arrange the collar, and then use one hand to hold the tie knot (42) and another hand to pull the loop cord (3) from the back of the fabric strip in order to smoothly move the tie knot (42) toward the collar. At this time, the collar ring (31) is completely covered by the collar and thus invisible as seen from the outside of the collar, and only the tie knot is exposed at the collar. Hence, the knotting-free necktie is the same as the conventional necktie in visual effect. When releasing the necktie, the user only need to pull the tie knot downward and take the collar ring away from the neck of the user. Hence, the knotting-free necktie in accordance with the present invention is very convenient for users.

The present invention is not limited by the forgoing description of the embodiments, the invention may be embodied in other specific forms without departing from the spirit or essential characteristic of the appended claims.

What is claimed is:

1. A structure of a supporter for a tie knot of a knotting-free necktie, comprising an outer shell and a back wing fitted onto said outer shell; said outer shell, as seen from its front view, being of a reverse triangular shape having two waist portions which are concave inward of the outer shell, and as seen from its top view, being of a bow shape; a protective beam being provided at the lower portion of the rear side of the outer shell and connected to the two sides of the outer shell to form a space under the protective beam for the passing of a loop cord and controlling the movement of the loop cord; two projecting resistant shoulders being provided the at the upper portion of the rear side of the outer shell, and two protective tabs bending inward being provided at the two sides of the upper edge of the outer shell;

said back wing, as seen from its front view, being substantially of a cross shape; two side wing portions, which are somewhat bent upward, being formed at the two sides of a wing trunk of the back wing respectively; said wing trunk having a hanging portion formed at its top end and a fixing hole formed at its lower end, and being able to be hung onto the rear side of the outer shell and being fixed thereon by means of a rivet.

* * * * *